US010745166B2

(12) United States Patent
de Boer et al.

(10) Patent No.: US 10,745,166 B2
(45) Date of Patent: Aug. 18, 2020

(54) PREFOLDED CARDBOARD BLANK, METHOD AND SYSTEM FOR FOLDING CLOSED PACKAGING BOXES OF VARYING HEIGHT AND LENGTH

(71) Applicant: NEOPOST TECHNOLOGIES, Bagneux (FR)

(72) Inventors: Fokke de Boer, Drachten (NL); Herman Sytema, Drachten (NL)

(73) Assignee: QUADIENT TECHNOLOGIES FRANCE, Bagneux (FR)

( * ) Notice: Subject to any disclaimer, the term of this patent is extended or adjusted under 35 U.S.C. 154(b) by 0 days.

(21) Appl. No.: 16/141,525

(22) Filed: Sep. 25, 2018

(65) Prior Publication Data

US 2019/0092513 A1 Mar. 28, 2019

(30) Foreign Application Priority Data

Sep. 27, 2017 (EP) ..... 17193537

(51) Int. Cl.
*B65D 5/355* (2006.01)
*B65D 5/02* (2006.01)
(Continued)

(52) U.S. Cl.
CPC ..... *B65D 5/0005* (2013.01); *B31B 50/006* (2017.08); *B31B 50/0044* (2017.08);
(Continued)

(58) Field of Classification Search
CPC .. B65D 5/0005; B65D 5/0236; B65D 5/4266; B65D 5/241; B65D 5/3678
(Continued)

(56) References Cited

U.S. PATENT DOCUMENTS 4,433,778 A * 2/1984 Maio ..... B65D 5/5206 206/45.21
4,512,541 A * 4/1985 Lietzke ..... A47F 5/112 206/45.25
(Continued)

FOREIGN PATENT DOCUMENTS

FR 2 784 656 A1 4/2000
FR 2 987 824 S1 9/2013
(Continued)

OTHER PUBLICATIONS

European Search Report for EP17193537.2, dated May 28, 2018, 9 pages.

*Primary Examiner* — Christopher R Demeree
(74) *Attorney, Agent, or Firm* — Cozen O'Connor

(57) ABSTRACT

Prefolded cardboard blank for folding closed packaging boxes of varying height and length, said blank comprising a bottom panel, two side panels, each joined to opposite edges of said bottom panel and a first end panel joined with a first edge to said bottom panel, with a second edge to one of said side panels and with a third edge to the other one of said side panels such that the first end panel and the side panels when erected from the bottom panel form together with the bottom panel a box having an open top and an open side, the first end panel having an end portion intended to form a first top panel, each side panel having an end portion intended to form at least one second top panel and a corner panel, the bottom panel having an end portion intended to form a second end panel and a third top panel, and each side panel having a crease line running at an angle of 45° upwards from a corner, where the edges of the respective side panel, the first end panel and the bottom panel meet.

17 Claims, 10 Drawing Sheets

(51) Int. Cl.

| | |
|---|---|
| ***B65D 5/42*** | (2006.01) |
| ***B31B 50/00*** | (2017.01) |
| ***B31B 50/26*** | (2017.01) |
| ***B31B 50/20*** | (2017.01) |
| ***B65B 43/10*** | (2006.01) |
| ***B65B 43/24*** | (2006.01) |
| *B31B 120/10* | (2017.01) |
| *B65B 61/02* | (2006.01) |
| *B31B 105/00* | (2017.01) |
| *B31B 110/35* | (2017.01) |

(52) U.S. Cl.
CPC ..... *B31B 50/20* (2017.08); *B31B 50/26* (2017.08); *B31B 50/262* (2017.08); *B65B 43/10* (2013.01); *B65B 43/24* (2013.01); *B65D 5/0236* (2013.01); *B65D 5/4266* (2013.01); *B31B 2105/0024* (2017.08); *B31B 2110/35* (2017.08); *B31B 2120/102* (2017.08); *B65B 61/02* (2013.01); *B65B 2210/04* (2013.01)

(58) Field of Classification Search
USPC ..... 229/101, 164, 117.01, 117.07
See application file for complete search history.

(56) References Cited

U.S. PATENT DOCUMENTS

| | | | | |
|---|---|---|---|---|
| 5,180,052 | A * | 1/1993 | Smith | B65D 5/5023 206/485 |
| 6,227,438 | B1 * | 5/2001 | Hiltke | A47F 3/14 220/8 |
| 2015/0360433 | A1 | 12/2015 | Feijen et al. | |
| 2017/0042345 | A1 * | 2/2017 | Jolley | A47F 5/114 |
| 2018/0344056 | A1 * | 12/2018 | Ferrer-Walsh | A47F 5/112 |

FOREIGN PATENT DOCUMENTS

| | | |
|---|---|---|
| GB | 371751 | 4/1932 |
| GB | 2 167 043 A | 5/1986 |
| WO | 2013/117852 A1 | 8/2013 |
| WO | 2014/117816 A1 | 8/2014 |
| WO | 2014/117817 A1 | 8/2014 |
| WO | 2016/059218 A1 | 4/2016 |
| WO | 2016/157089 A1 | 10/2016 |

* cited by examiner

PREFOLDED CARDBOARD BLANK, METHOD AND SYSTEM FOR FOLDING CLOSED PACKAGING BOXES OF VARYING HEIGHT AND LENGTH

TECHNICAL FIELD

The application relates to a prefolded cardboard blank, a method and a system for folding closed packaging boxes of varying height and length, in particular to facilitate packaging items that vary in size and number for shipment.

BACKGROUND

Mail ordering has become a widely used way of buying goods. More and more companies offer virtual department stores, in which the customers can electronically put goods in a shopping cart that later will be transferred by the respective company into a dispatch order, so that in a warehouse a shipment comprising the items ordered (and sometimes additional items such as samples, vouchers, invoices, etc.) can be assembled based on the respective dispatch order.

While assembling a shipment in a warehouse of a specialized distributor is nowadays often done more or less fully automated, packaging the items to be shipped is still a challenge, in particular when a shipment comprises several items of different sizes and in different quantities. Often, the items to be packaged are provided automatically to a person packaging the items manually. Depending on the size and number of the items, the person selects a suitable box size. Generally the box is a cardboard box that upon packaging is assembled from a corresponding cardboard blank.

To automate the packaging process even in cases where the items vary in size and number, a system has been proposed in WO 2014/117817 A1 that allows creating a fully custom sized box, i.e. a box, of which width, length and height are adapted to the respective content of the box. The box is created from a roll or a stack of cardboard by cutting out and creasing a custom sized blank from which then the box is folded automatically.

WO 2016/059218 A1 discloses a system and a method for automatically packaging items varying in size and number applying two separate packings, namely an inner packing surrounding the items to be packaged in a first direction, and an outer packing surrounding the inner packing in a second direction, said second direction being substantially perpendicular to the first direction such that the inner and the outer packing form a combined package enclosing the package items from all sides.

WO 2013/117852 A1 discloses a system and a method for reducing the height of a cardboard box to the apex of the highest item in the box. In this respect, it should be noted that the terms "height", "length" and "width" as used herein refer to the usual definitions of the three dimensions of a box having the shape of a rectangular block with a rectangular bottom and two pairs of parallel rectangular sidewalls, wherein

- the height of the box is defined by the length of the sidewalls in the direction from the bottom to the top of the box,
- the width of the box is defined by the length of the bottom between the first pair of parallel sidewalls, usually the pair of sidewalls forming for an observer the left and the right sidewalls of the box, and
- the length (sometimes also called depth) of the box is defined by the length of the bottom between the second pair of parallel sidewalls, usually the pair of sidewalls forming for an observer the front and the back of the box.

It is obvious that depending on the position of the observer, the terms length and width can be interchanged. For sake of simplicity, in the following it is assumed that the box is seen from one perspective and length and width hence have a distinct meaning, which however is not limiting and obviously what in the following is called width can be named length (or depth) and vice versa.

While the known systems and methods work well for a number of applications, it has turned out that there is a need for optimization of the packaging process under a number of aspects. Depending in particular on the number and the shape of the items to be packaged, creating a custom sized box around items to be packaged can be difficult. If prefolded boxes are used as disclosed in WO 2013/117852 A1, of which only one dimension, namely the height, can be adapted to the actual content, the finished package may not be optimal with respect to volume, while transportation costs often depend not only on the weight, but also on the volume of a package. Besides, placing the items in a prefolded box having the standard rectangular block shape with a bottom and four sidewalls and being open only towards the top usually requires gripping and lifting the items over one of the sidewalls, which in particular in cases, in which a huge variety of items of different shapes and sizes needs to be packaged, can be difficult to automate.

Known systems for automatically creating custom-sized cardboard boxes are generally quite complex and hence expensive in acquisition and maintenance, so that they only pay off for companies sending out large numbers of packages. In order to be able to always use appropriately sized boxes, small online shops and retail stores offering shipment either have to keep a broad variety of different boxes ready for packaging items varying in size and number to be shipped or they have to use rather complex blanks as disclosed in FR 2 987 824 A1 for creating cardboard boxes and corresponding separate lids adapted to the size and number of the items to be packaged.

The blanks proposed in FR 2 987 824 A1 for creating a box and a corresponding lid comprise numerous crease lines/indentations and cuts to facilitate folding a box and a corresponding lid having different dimensions. As a broad variety of possible boxes and lids can be formed with the blanks according to FR 2 987 824 A1, different sections formed by the crease lines and cuts are coloured differently to allow the user to identify, which sections have to be folded in order to create a box or a lid of a certain size. Due to the high number of crease lines and cuts, the stability of a corresponding box and a lid is not optimal. Moreover, producing such coloured blanks with numerous crease lines and cuts is complex and hence expensive.

GB 371 751 A discloses a blank of cardboard for use in the making of a wrapper or box. The blank has a cruciform shape so as to provide a flap on each side of a rectangular bottom panel. A series of ribs is formed in the blank, all being pressed out from one side of the blank to cover the entire area thereof. The ribs are arranged in parallel longitudinal rows and parallel transverse rows.

GB 2 167 043 A discloses a variable depth container is disclosed, which is formed form a blank which comprises a rectangular base portion having flaps respectively hinged to each of the sides. The panels cooperate to define the top of the contained and its side and end walls. Fold lines provided in the side and end walls facilitate variation in the depth of the container and lines of weakness permit removal of portion of flaps according to the container depth chosen.

SUMMARY

Described herein are a prefolded cardboard blank, a method and a system for folding closed packaging boxes that can easily be customized in two dimensions, height and length, without the need of complex cutting, creasing and folding mechanisms.

The object is achieved by a prefolded cardboard blank according to claim 1 respectively a method according to one of claims 8 and 9. Claims 13 and 14 each concern a system for automating the folding of a closed packaging box from a prefolded cardboard blank according to the invention. The respective dependent claims refer to advantageous embodiments of the respective independent claims.

The various described embodiment are based on the idea that a prefolded cardboard blank designed as set forth in claim 1 and described in further detail below easily allows adapting the length and the height of a box to the respective size needed, wherein of course a respective box to be folded can only have a certain maximum size depending on the dimensions of the blank. Reducing the height and/or length of a box to be folded from the given maximum dimensions can easily be achieved with a prefolded blank according to the invention without the need of special tools other than a cutter or knife and optionally a creasing tool like a handheld roller or folding stick, which allows also shops and stores sending out only a limited number of packages to create customized boxes and hence to reduce shipping costs that depend on the volume of the boxes and to reduce the amount of filling material necessary for preventing that items in a box that is to large fall around and get damaged. The prefolded cardboard blank has in each side panel a crease line running at an angle of 45° upwards from a corner, where the edges of the respective side panel, the first end panel and the bottom panel meet. This allows folding the first end panel onto the bottom panel while each side panel is folded down on itself, so that the blank is completely flat for storage and transportation.

The blank may be formed from a single piece of cardboard, so that advantageously any acts of attaching different pieces to each other are avoided. However, in particular if very stable boxes are needed, the cardboard blank can also be formed from two or more pieces of cardboard, and in particular the bottom panel may be formed from a first piece of cardboard and the first end panel and the side panels may be formed from a second piece of cardboard. This can reduce waste material, as the substantially rectangular panels are usually cut out from rectangular cardboard. Moreover, the cardboard used for the invention is generally so-called double faced corrugated cardboard, wherein a corrugated layer is sandwiched between two flat layers. Such cardboard has preferred creasing directions, namely all directions running parallel to the troughs and crests of the corrugated layer. Hence, using two pieces of corrugated cardboard for creating the blank allows to ensure that the troughs and crests in the first end panel run and in the side panels from the bottom panel to the top giving high stability to these panels, while the troughs and crests of the bottom panel may run parallel to the lines where the bottom panel will have to be folded to create a second end panel and a top panel for closing the box.

Further details and advantages of the invention will become apparent from the following exemplary and non-limiting description of preferred embodiments in conjunction with the drawings.

DETAILED DESCRIPTION OF PREFERRED EMBODIMENTS

Figure 1:
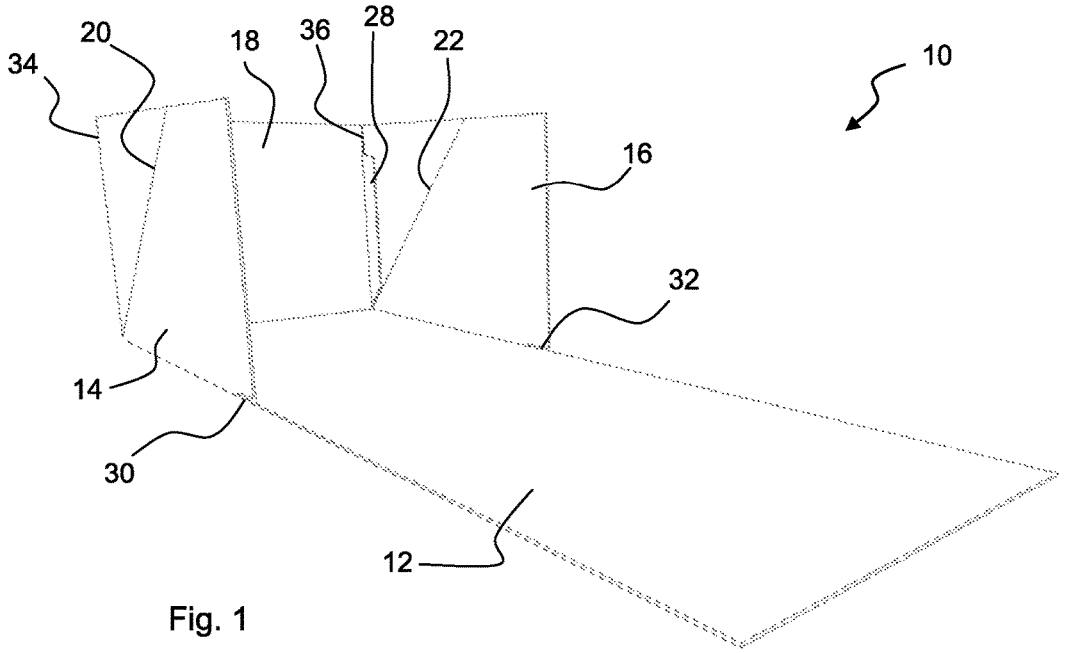
FIG. 1 shows a prefolded cardboard blank according to one embodiment of the invention, wherein the side walls and the first end panel are erected.

FIG. 1 shows a prefolded cardboard blank 10 comprising a bottom panel 12, two side panels 14 and 16, each joined to opposite edges of the bottom panel 12, and a first end panel 18 joined with a first edge to the bottom panel 12, with a second edge to the side panel 14 and with a third edge to the side panel 16 such that the first end panel 18 and the side panels 14 and 16 together with the bottom panel 12 in the shown state, where the side panels 14 and 16 and the end panel 18 are erected from the bottom panel 12, form a box having an open top and an open side, namely in this view the front side of the box.

Figure 4:
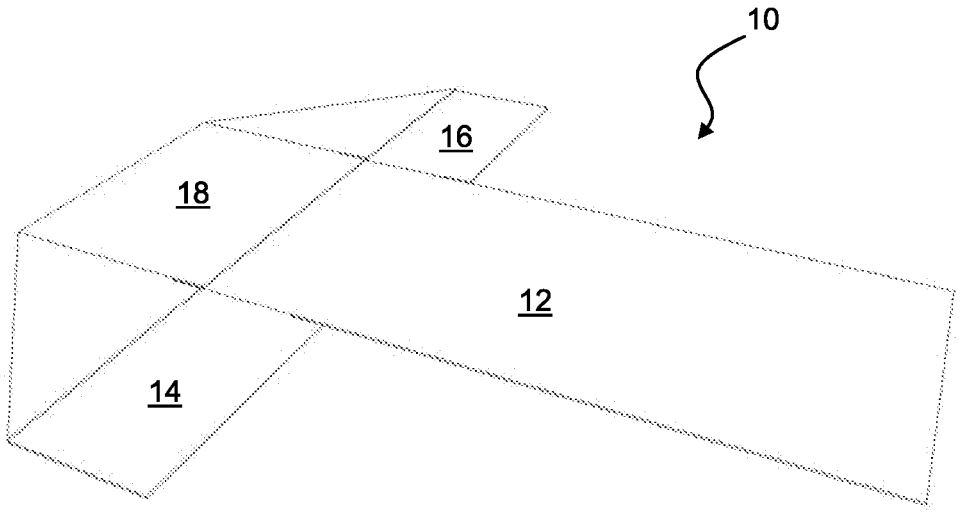
FIG. 4 shows a prefolded blank made either from a cardboard cut according to the embodiment shown in FIG. 2 or the cardboard cuts embodiment shown in FIG. 3, in a folded down state for transporting and storing the blank.
Figure 5:
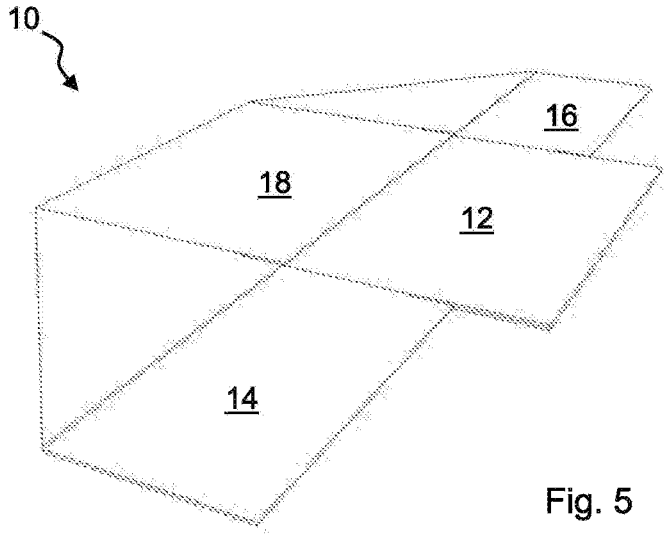
FIG. 5 shows the blank according to FIG. 4 in a state, where the bottom panel is folded backwards on itself for reducing the size needed for storing and transporting the blank.

In this embodiment, each side panel 14 and 16 is provided with a crease line 20 resp. 22, which runs at an angle of 45° upwards from the respective corner, where the edges of the respective side panel 14 resp. 16, the first end panel 18 and the bottom panel 12 meet. These crease lines 20 and 22 facilitate, as shown in FIGS. 4 and 5, folding down the first end panel 18 onto the bottom panel 12 for transporting and storing the prefolded cardboard blank.

Figure 2:
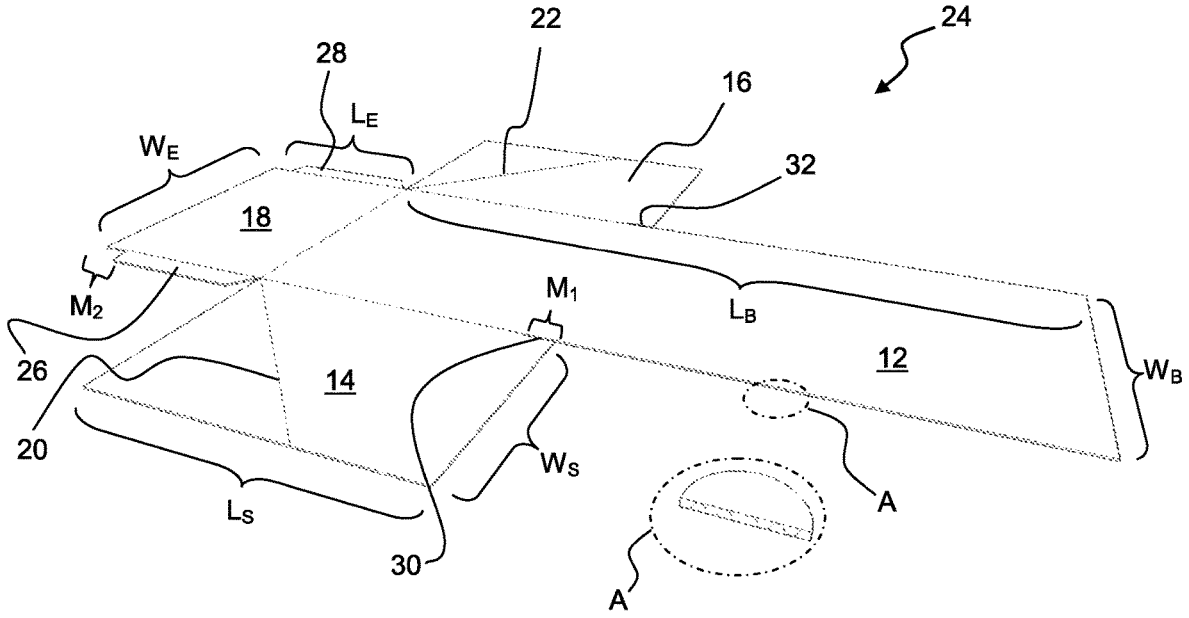
FIG. 2 shows a cardboard cut for making the prefolded blank according to FIG. 1.

The prefolded cardboard blank 10 shown in FIG. 1 is made from a cardboard cut 24 shown in FIG. 2.

The cardboard cut 24 in this embodiment is cut out or incised from a single piece of corrugated cardboard, namely from so-called double-faced corrugated cardboard, in which a corrugated layer is sandwiched between two flat layers. As schematically indicated by the enlarged portion A of FIG. 2, the troughs and crests of the corrugated layer run parallel to the joining edge of the bottom panel 12 and the first end panel 18, which facilitates folding the first end panel 18 to form a first top panel and folding the end portion of the bottom panel 12 to form a second end panel and a third top panel as will be explained later.

In this embodiment, the first end panel 18 is provided with two joining flaps 26 and 28 for attaching the side panels 14 and 16 to the first end panel 18 by gluing a respective portion of the side panels 14 and 16 to the respective flap 26 resp. 28 of the first end panel 18 after folding the first end panel 18 and the side panels 14 and 16 upwards from the bottom panel 12.

In this embodiment, the cardboard cut 24 is already provided with two slits 30 and 32 running along a portion of the edge between the bottom panel 12 and the side panels 14 resp. 16 in the direction from the free end of the bottom panel 18 towards the first end panel. The slits 30 and 32 have a length $M_1$ which determines the minimum length of corner panels to be folded from the side panels and hence the maximum length of the box to be folded from the blank, as the box length corresponds to the length of the side panels 14 and 16 after folding the said corner panels. This will be easily understood when the folding acts are described.

As the joining flaps 26 and 28 terminate slightly underneath the free end of the first end panel 18, slits 34 and 36 (shown in FIG. 1) of length $M_2$ are automatically formed between the end portions of the side panels 14 and 16 and the end portion of the first end panel 18 when the flaps 26 and 28 are glued to the side panels 14 and 16. Similar to the length $M_1$ of the slits 30 and 32, the length $M_2$ of the slits 34 and 36 determines the minimum length of a top panel formed by folding down the free end of the first end panel 18 and thus determines the maximum height of the box, as the maximum height is the length of the top end panel 18 (seen in the direction from the joining edge of the top end panel 18 and the bottom panel 12 in the direction of the free end of the first end panel 18) minus the minimum length $M_2$ of the top panel folded from the first end panel. Both lengths $M_1$ and $M_2$ of the slits and thus the minimum length of the corner panels respectively and the first top panel depend on the desired stability of the box and the properties of the cardboard used for making the prefolded blank. Typically, $M_1$ will be the same as $M_2$.

In the terminology used herein for describing the embodiments of the invention, each panel has a width and a length. As depicted in FIG. 2, the total length $L_B$ of the bottom panel 12 is taken in the direction from the first end panel 18 towards the free end of the bottom panel, and all other lengths, the total length $L_E$ of the first end panel 18 and the total length $L_S$ of the side panels are taken in the same direction. The width $W_B$ of the bottom panel is taken in a direction parallel to the joining line between the bottom panel 12 and the first end panel 18 and likewise, all other width, the width WE of the first end panel 18 and the width $W_S$ of the side panels are taken in the same direction. Although in the embodiment shown in FIG. 2 the joining flaps 26 and 28 are formed as integral parts of the first end panel 18, when speaking of the width WE of the bottom panel only the width after folding the bottom panel upwards and connecting the joining flaps with the side panels is meant by the term width.

As is apparent from the teaching herein, the length $L_E$ of the first end panel 18 and the width $W_S$ of the side panels 14 and 16 determine the height of the open box shown in FIG. 1. As the upper end portions of the first end panel 18 and the side panels 14 and 16 shown in FIG. 1 are intended to be folded inwards to form top panels, the maximum height H of the finally created box is, as explained above, less than the total length $L_E$ of the first end panel 18 and less than the total width $W_S$ of the side panels 14 and 16. Likewise, as the front end portions shown in FIG. 1 of the side panels 14 and 16 are intended to be folded inwards to form corner panels, the total length L of a finally folded box is less than the length $L_S$ of the side panels 14 and 16. In as far certain relations of dimension are given herein, it is apparent from the teaching herein that there are typical material-caused tolerances, i.e. cardboard is generally not cut with the same preciseness as e.g. cog wheels of mechanical watches, such that "equals" rather means "approximately the same", while deviations of e.g. 1 mm in the panels generally do not adversely affect folding the desired box.

Figure 3:
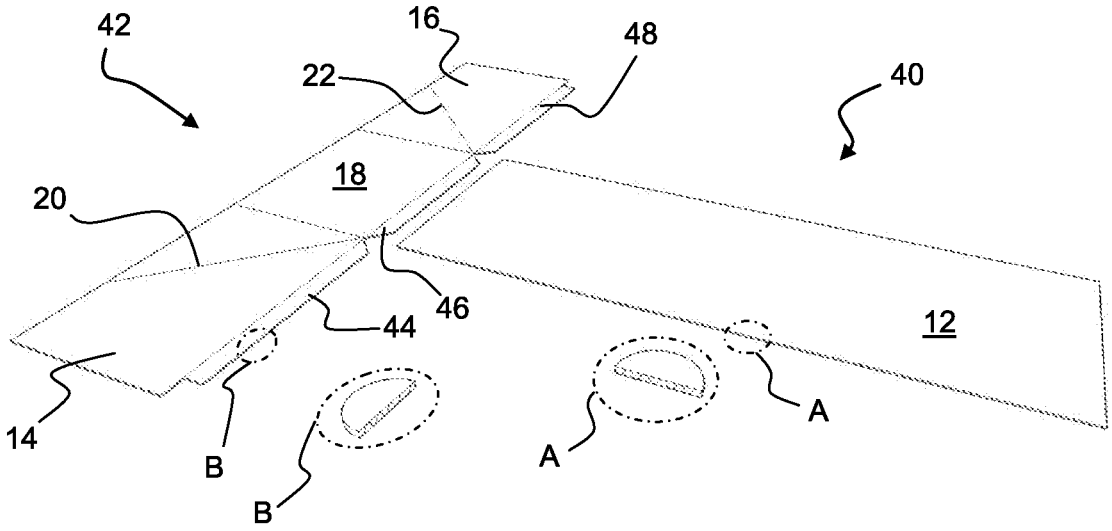
FIG. 3 shows two cardboard cuts, which can be attached to each other for making a prefolded cardboard blank according to another embodiment of the invention.

FIG. 3 shows two cardboard cuts 40 and 42, from which a prefolded cardboard blank can be formed. Cut 40 is used to form the bottom panel 12, whereas cut 42 is used to form the first end panel 18 and the side panels 14 and 16. Again, the side panels are provided with crease lines 20 and 22 as described above. In this embodiment, the cut 42 is provided with three joining flaps 44, 46 and 48, which are used to attach the side panels 14 and 16 and the first end panel 18 to the bottom panel 12. In this embodiment, the joining flaps 44 and 48 do not run over the entire length of the side panels 14 and 16 in order to form slits of length $M_1$ like the slits 30 and 32 shown in FIG. 1.

As schematically indicated by the enlarged sections A and B, the orientation of the corrugated cardboard used for the cuts 40 and 42 is offset by 90° such that the troughs and crests in the bottom panel 12 run parallel to the joining edge between the bottom panel 12 and the first end panel 18 and the troughs and crests in the cut 42 parallel to the joining edges between the side panels 14 and 16 and the first end panel 18. This orientation of the troughs and crests ensures that the bottom panel 12 can easily folded at desired fold lines to form a second end panel and a top panel as will be explained later, while the side panels 14 and 16 and the first end panel 18 have a high stability perpendicular to potential fold lines in the bottom panel 12, ensuring a high stability of a box finally created from the respective blank.

FIGS. 4 and 5 show a blank 10 like the one shown in FIG. 1 in a state for transporting and storing the blank. The blank could be a blank made from a cardboard cut as shown in FIG. 2 or to cardboard cuts as shown in FIG. 3. Making use of the crease lines 20 and 22 shown in FIGS. 1 to 3, the first end panel 18 has been folded down onto the bottom panel 12, and accordingly each of the side panels 14 and 16 is folded down on itself. In order to further reduce the size for storing and transporting the blank 10, the bottom panel 12 may be folded backwards onto itself as shown in FIG. 5. Depending on the object to be achieved by such folding, the fold line, around which the bottom panel 12 is folded backwards onto itself, can freely be chosen: if a minimum surface area is prioritised, the bottom panel 12 may, as shown in FIG. 5, be folded backwards onto itself at a position, where the total length of the first end panel 18 and the bottom panel 12 are reduced to 50%. If the thickness of the blank shall be optimised, the bottom panel maybe folded upwards onto itself at a position, such that its free end edge abuts against the respective edge of the first end panel 18, so that the thickness of the blank folded down is only two layers of cardboard high, provided that a cardboard cut like the cardboard cut 24 shown in FIG. 2 is used for making the cardboard blank, since such cardboard cut 24 ensures that the joining flaps do not increase the thickness of a blank folded down as shown in FIGS. 4 and 5.

FIGS. 6-13 show several stages of folding a custom-sized closed packaging box using a prefolded cardboard blank according to the invention. As there are no joining flaps between the first end panel 18 and the side panels 14 and 16 visible, one may assume that the prefolded box 10 is made from two separate cardboard cuts as shown in FIG. 3, but the following description holds true for a prefolded cardboard blank as the one shown in FIG. 1, so that the same reference numbers are used throughout the figures. Also, to simplify the drawings, the crease lines 20 and 22 shown in FIGS. 1 to 3 are not shown in the remaining Figures, although in reality these lines of course are still present in the cardboard and would, depending on the perspective, be visible to an observer.

Figure 6:
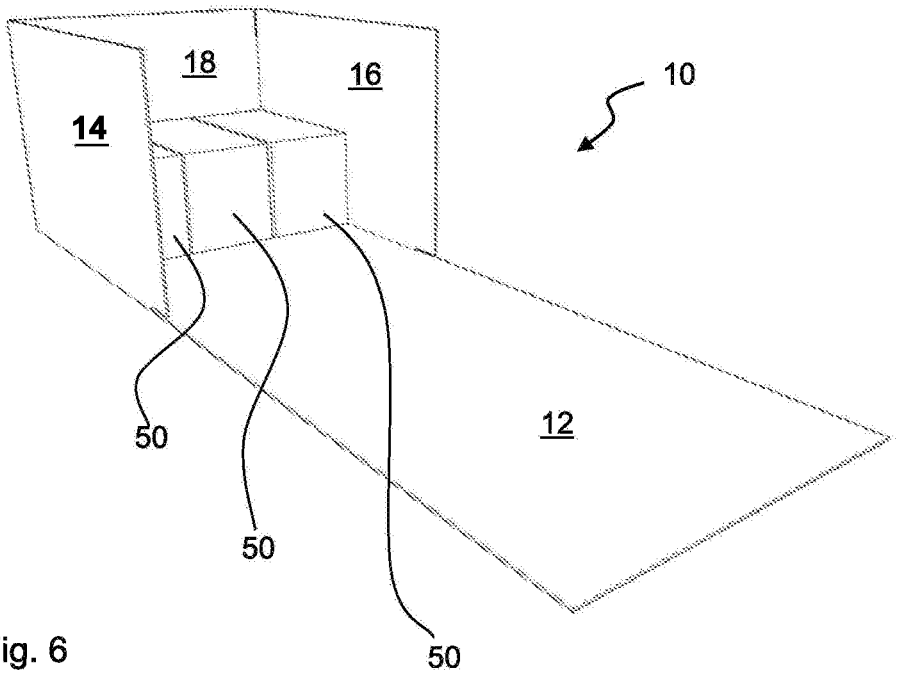
FIG. 6 shows a prefolded cardboard blank in a state, in which some items have been placed in a partially open box formed by certain panels of the blank.

As shown in FIG. 6, some items, in the exemplary case three apparently identical items 50 have been assembled in the prefolded blank 10 so that they abut against the first end panel 18 and also against the side panel 16. One advantage of the prefolded blank is that it may already be used for assembling the items to be shipped. For that purpose, the blank (of course with erected first end panel and erected side panels) may be placed on a trolley used by an order picker to pick up the items of an order from a storage. Obviously, the trolley could advantageously also be adapted to hold the prefolded blank slightly inclined such that the items placed in the partially open box formed by the side panels, the bottom panel and the first end panel cannot fall out of the box. While for sake of simplicity the items 50 shown in the figures are of rectangular shape, the shape, size and number of the items does not matter (of course as long as the overall dimensions of the items do not exceed the maximum dimensions of the box foldable from the prefolded blank).

Figure 7:
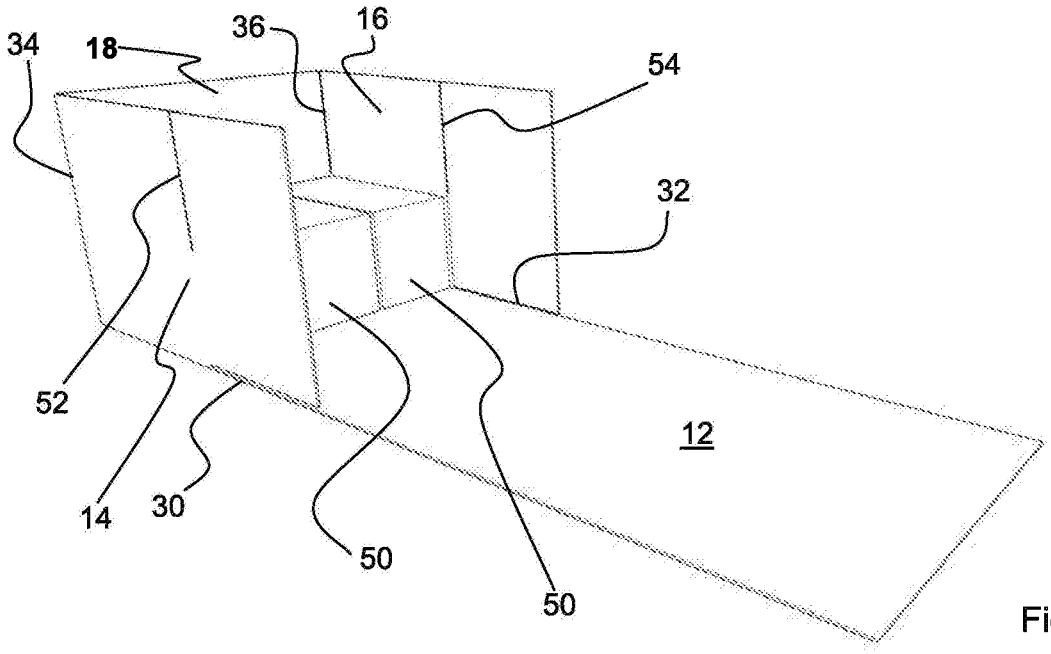
FIG. 7 shows the blank according to FIG. 6 in a state, in which certain incisions have been made.

If an order to be shipped is completely in the box that is still open towards the front and towards the top, in a first act the slits 30 and 32 and 34 and 36 are extended up to a position, where the panels closing the yet open box shall be created. This stage is schematically shown in FIG. 7. While in the shown embodiment the prefolded blank is already provided with slits 30-36, it is obvious that such slits do not need to be present and can be formed only after assembling the items. It should also be noted that as schematically indicated in the drawings, at least in the previously formed slits 30-36 actually some cardboard material is taken out (so that the slits actually form slots), but they may as well be simply formed by incising the cardboard without cutting out any material.

As further depicted in FIG. 7, incisions 52 and 54 are made in the side panels 14 and 16 down from the open top end down to the desired height of the box to be folded, which in the present case is determined by the height of the items 50.

Figure 8:
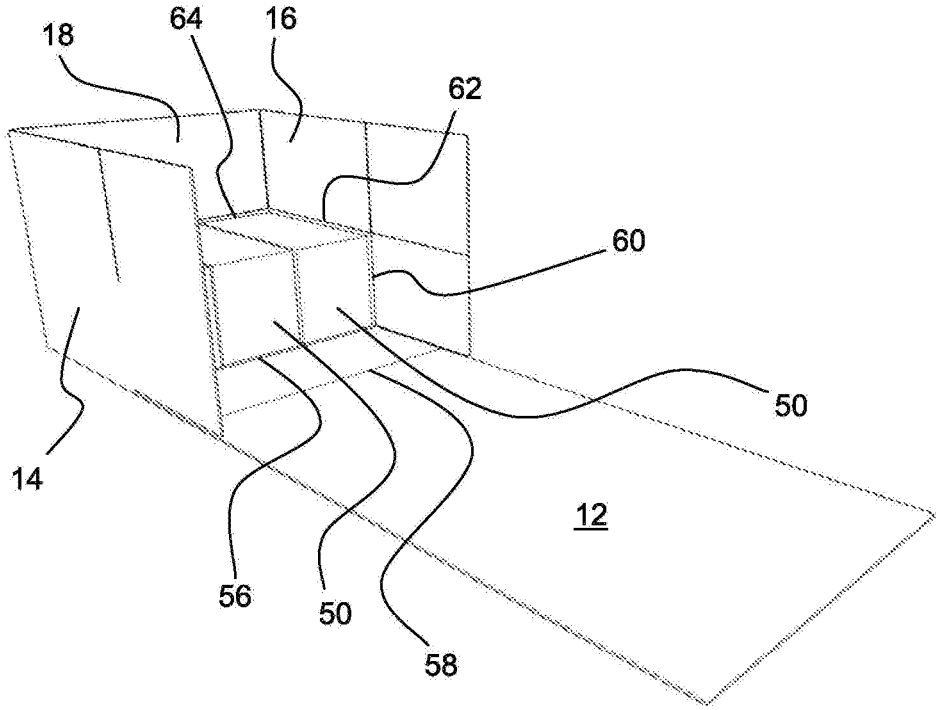
FIG. 8 shows the blank according to FIG. 7 in a state, in which certain crease lines have been made.

FIG. 8 shows the state after performing an optional but preferred act of indenting crease lines 56 and 58 in the bottom panel 12, crease lines 60 and 62 in each side panel, of which in the present view only the crease lines in the side panel 16 are visible, and a crease line 64 in the first end panel 18. These crease lines facilitate folding the panels and can easily be indented manually by using a crease roller or a folding stick. However, it is also possible to automate this process using a so called creasing station known in the art, in which one or more crease rollers are automatically guided along respective paths to create the crease lines.

Figure 9:
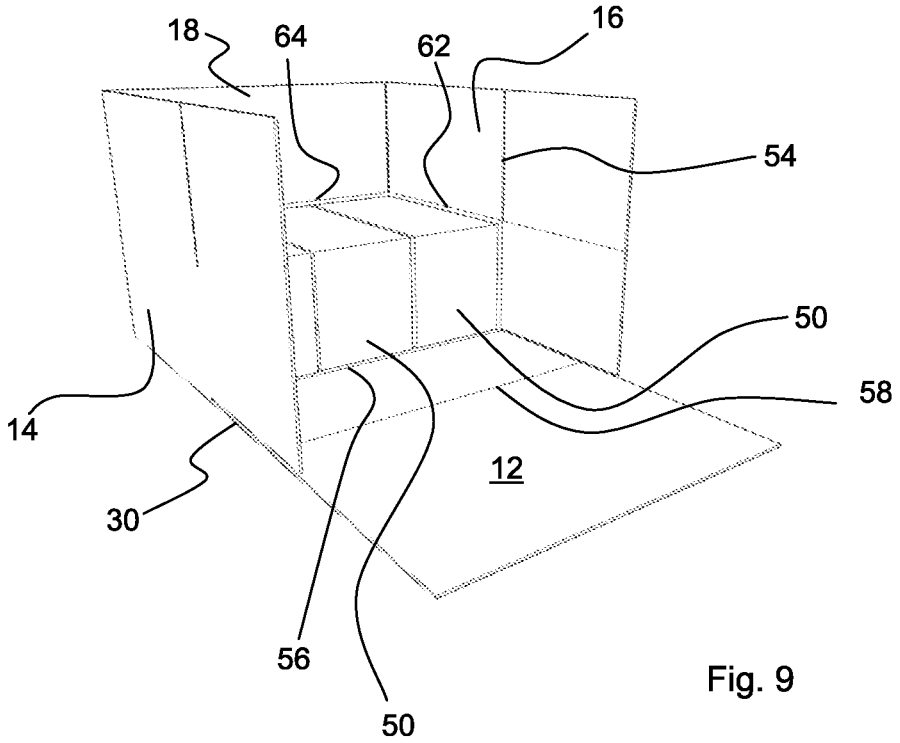
FIG. 9 shows the blank according to FIG. 8 in a state, in which the bottom panel has been shortened.

FIG. 9 shows the state after performing a further optional but preferred act of shortening the bottom panel 12, which may or may not be performed depending on the desired box design and the currently wanted length of the box. In the state shown on FIG. 9, the bottom panel 12 has been shortened such that its total length taken from the first end panel 18 towards the free end of the bottom panel 12 corresponds to twice the length of the box to be created plus the height of said box. With this design, the free end of the bottom panel 12 will terminate along an edge of the box, but it is apparent from the teaching herein that the bottom panel may be further shortened so that it terminates on the top of the box to be folded preferably with an overlap with the top panel to be created from the first end panel, such that the box can easily be closed by placing an adhesive strip along the end of the bottom panel, or any overhang of the bottom panel created when folding the bottom panel upwards and then downwards may be further folded downwards onto the part of the first end panel, which in the closed state forms a rear panel of the box. The optional act of shortening the bottom panel may be performed manually or automatically by using a cutting station employing straight or rotatory knifes, straight or rotatory blades, saws, slitters, dies, lasers, hot wires.

It is apparent from the teachings herein that all cutting/incising and creasing/indenting acts described herein can be performed in any order and some may, in particular if automatic units are used, even be performed simultaneously. It is also apparent from the teachings herein that all cutting/incising may be achieved via one or more straight or rotatory knifes, straight or rotatory blades, saws, slitters, dies, lasers, hot wires, arms or mechanical appendages, belts, pulleys, electric motors, solenoids, and/or pneumatic or hydraulic pistons. It is also apparent from the teachings herein that all creasing/indenting can be achieved via dies, stamps, other indenting machines, arms or mechanical appendages, belts, pulleys, electric motors, solenoids, pneumatic and/or hydraulic pistons. It is also apparent from the teachings herein that all folding may be achieved via one or folding apparatus or mechanisms, e.g., folding table, suction cups, vacuum system, arms or mechanical appendages, belts, pulleys, electric motors, solenoids, and/or pneumatic or hydraulic pistons. It is also apparent from the teachings herein that all sealing may be achieved via one or sealing apparatus or mechanisms, e.g., sealing table, tape dispenser, adhesive dispenser, suction cups, vacuum system, arms or mechanical appendages, belts, pulleys, electric motors, solenoids, and/or pneumatic or hydraulic pistons. Various structures for use at the cutting station(s), indenting or creasing station(s), folding station(s), and/or sealing station(s) may include those described International patent application WO 2014/117816 A1 and U.S. patent application Ser. No. 14/764,398, each of which is incorporated herein by reference in its entirety.

Figure 10:
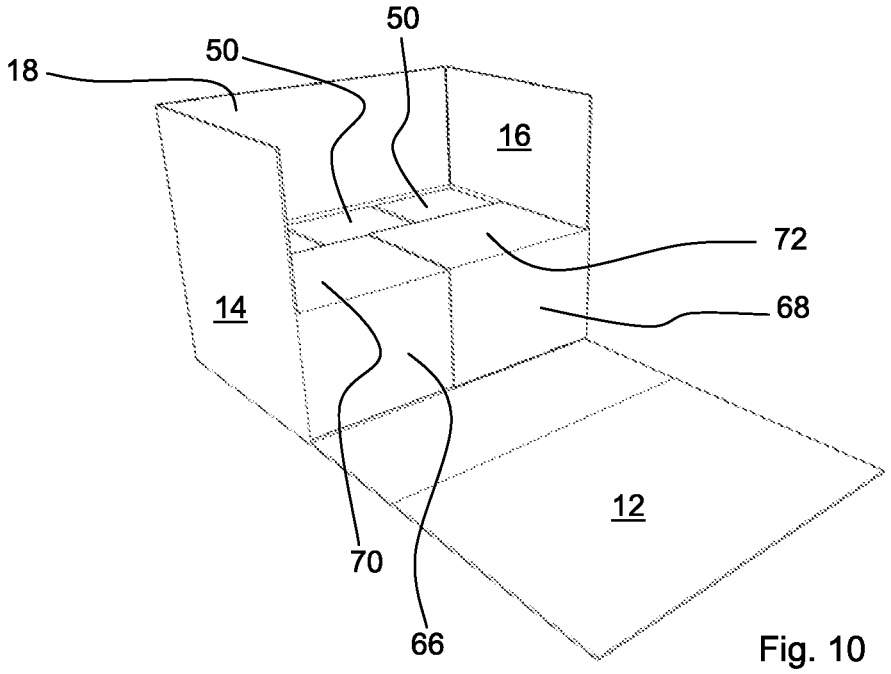
FIG. 10 shows the blank according to FIG. 9 in a state, in which the side panels have been folded inwards and the inward folded portions of the side panels have been folded downwards.
Figure 11:
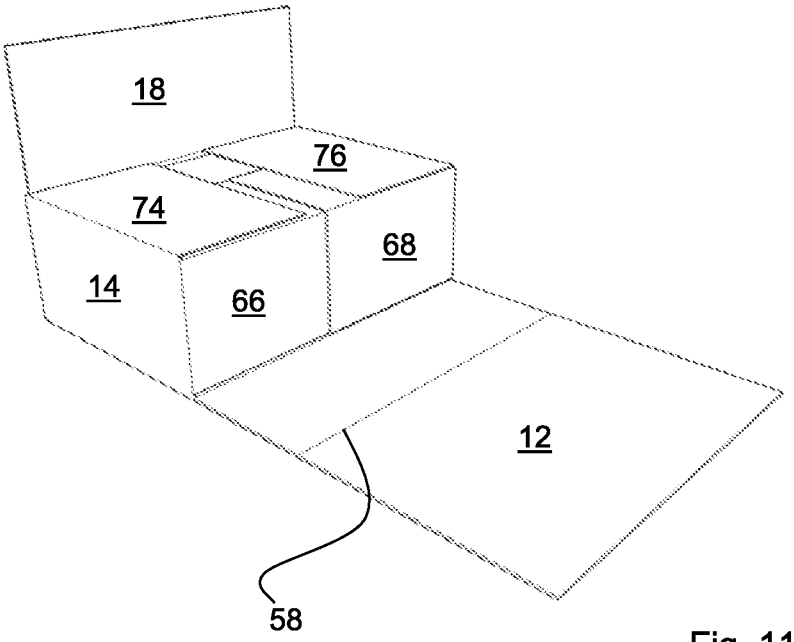
FIG. 11 shows the blank according to FIG. 10 in a state, in which the remaining parts of the side panels have been folded downwards.
Figure 12:
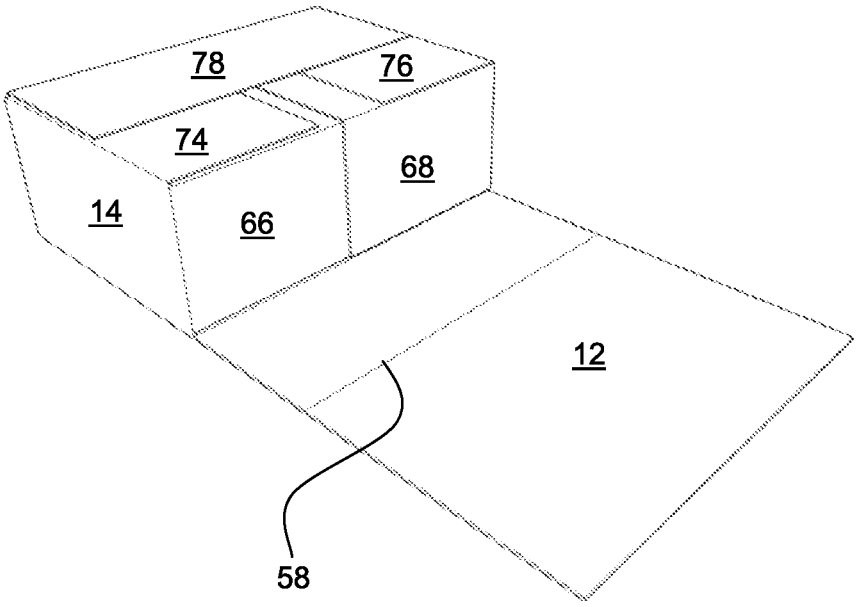
FIG. 12 shows the blank according to FIG. 11 in a state, in which the first end panel has been folded downwards.
Figure 13:
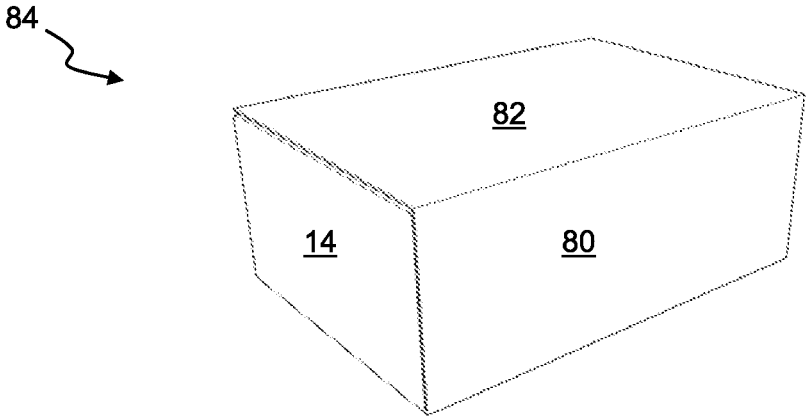
FIG. 13 shows the blank according to FIG. 12 in a state, in which the bottom panel has been folded upwards and then downwards to form a closed box.

FIG. 10 shows the prefolded blank 10 according to FIG. 9 in a state, in which the side panels 14 and 16 have first been folded inwards along the crease lines 60 to create corner panels 66 and 68, and the free ends of these corner panels have then been folded downwards into the box about to be finished to create top panels 70 and 72. The remaining portions of the side panels 14 and 16 are then, as depicted in FIG. 11, folded along the crease lines 62 downwards into the box to be formed, thus forming further top panels 74 and 76. The free end portion of the first end panel 18 is then folded down onto the top panels 74 and 76 as depicted in FIG. 12 to form a further top panel 78. Finally, the free end of the bottom panel 12 is folded upwards and then downwards onto the top panel 78 to form a second end panel 80 and a further top panel 82 as shown in FIG. 13. The thus created box 84 may then be closed by adhesive tape, hot melt glue or the like.

Figure 14:
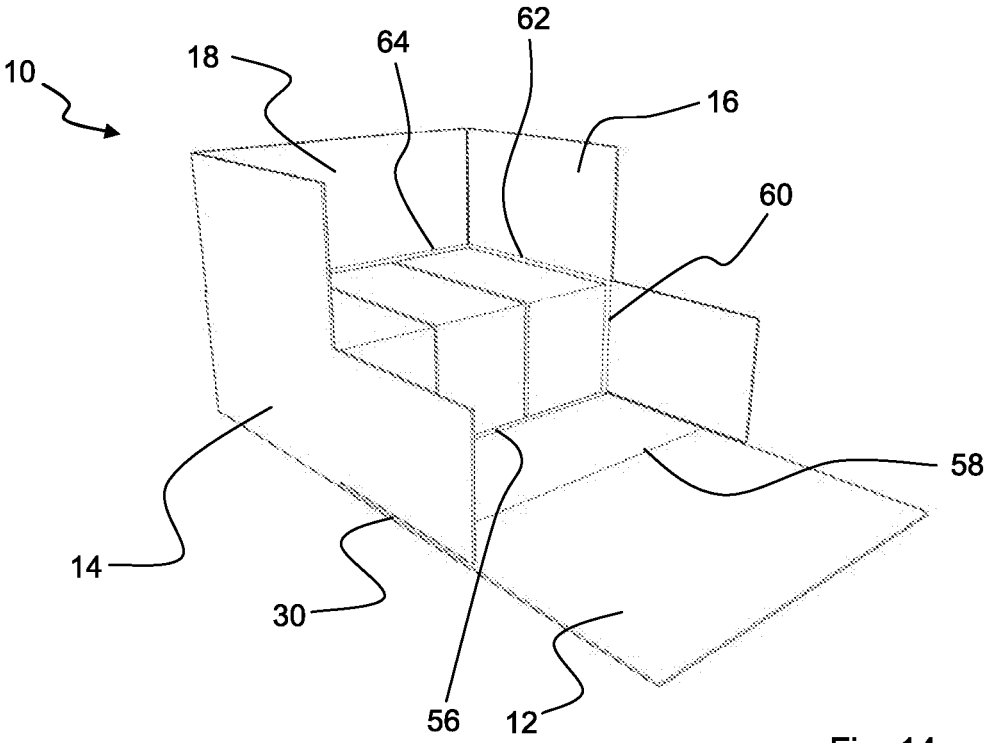
FIG. 14 shows a blank according to FIG. 9 in a state, in which according to another embodiment of the method according to the invention a certain portion of each side wall has been cut away, and a crease line has been indented in the bottom panel.

FIG. 14 shows a blank according to FIG. 9 in a state, in which according to another embodiment of the method according to the invention the portions of the side panels 14 and 16, that in the embodiment described above would form the top panels 70 and 72 (see e.g. FIG. 10) are cut away, thus reducing the overall weight of the packaging box to be created. Like all other cuts and incisions, this cutting can be done manually or as known in the art also automatically, and one or more cutting units like e.g. a laser cutting unit can be used for making the incisions/cuts and optionally shortening the bottom panel. In the state shown in FIG. 14, two crease lines 56 and 58 have been indented in the bottom panel 12, which has been shortened as shown in FIG. 9. Further crease lines 60 and 62 have been indented in each side panel 14 and 16, and a crease line 64 has been indented in the first end panel 18.

Figure 15:
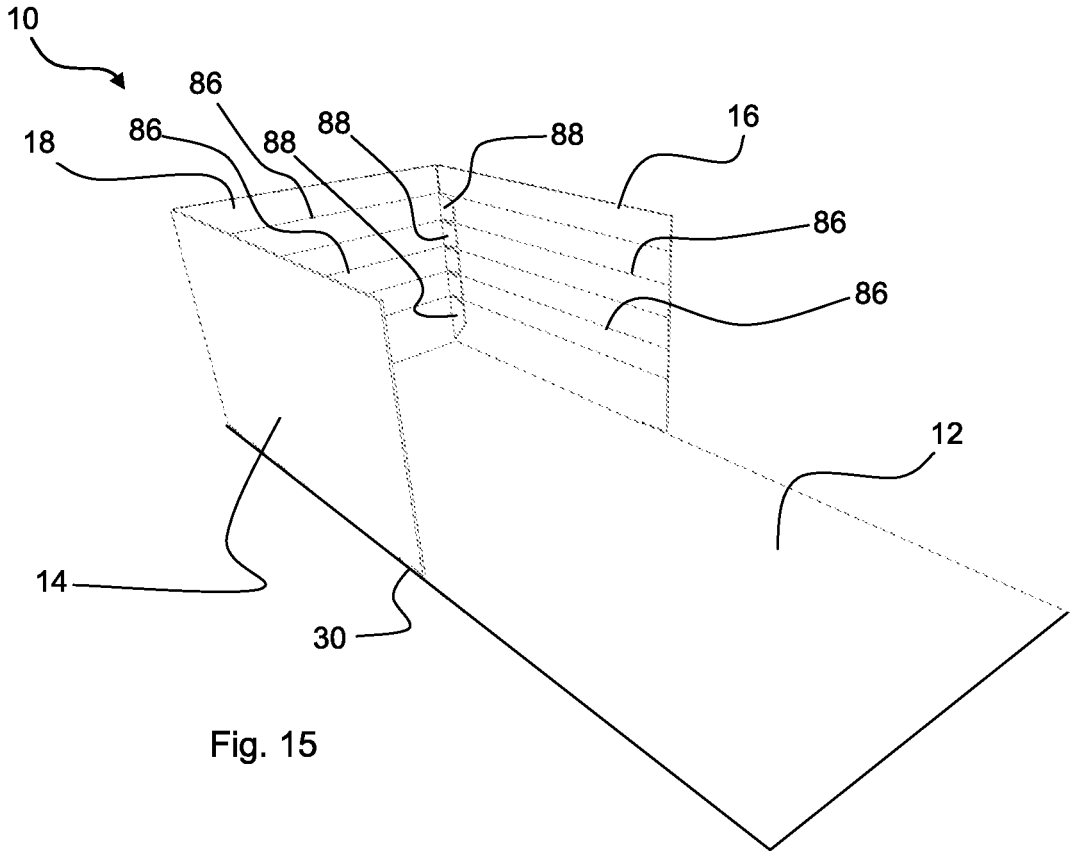
FIG. 15 shows another embodiment of a blank similar to the blank shown in FIG. 1, in which a certain number of crease lines have been indented in the first end panel and the side panels.

FIG. 15 shows another embodiment of a prefolded cardboard blank 10, in which the first end panel 18 and the side panels 14 and 16 have been provided with a certain number of parallel crease lines 86, of which only some are provided with reference numbers. The blank 10 is formed from a single piece of cardboard like the cardboard cut 24 shown in FIG. 2, but the joining flaps 26 and 28 shown in FIG. 2 are provided with slots at the positions, where the crease lines 86 run, so that they form a number of single joining flaps 88, of which again only some are provided with reference numbers. Such joining flaps 88 do not interfere with folding the panels along the crease lines 86. The embodiment shown in FIG. 15 facilitates customizing the height of a packaging box to certain predetermined heights, which can speed up the packaging process. The user simply has to prolong the slits 30-36 to the desired length and may, if wanted, also shorten the bottom panel 12.

Figure 16:
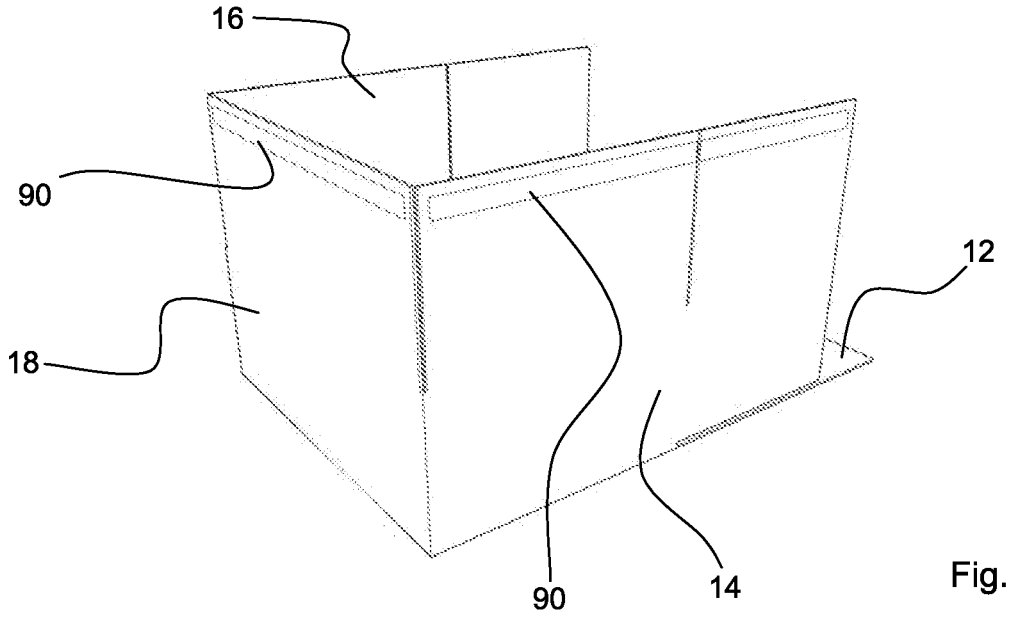
FIG. 16 shows a prefolded cardboard blank according to another embodiment of the invention, in which adhesive tape has been provided on certain portions of some of the panels.
Figure 17:
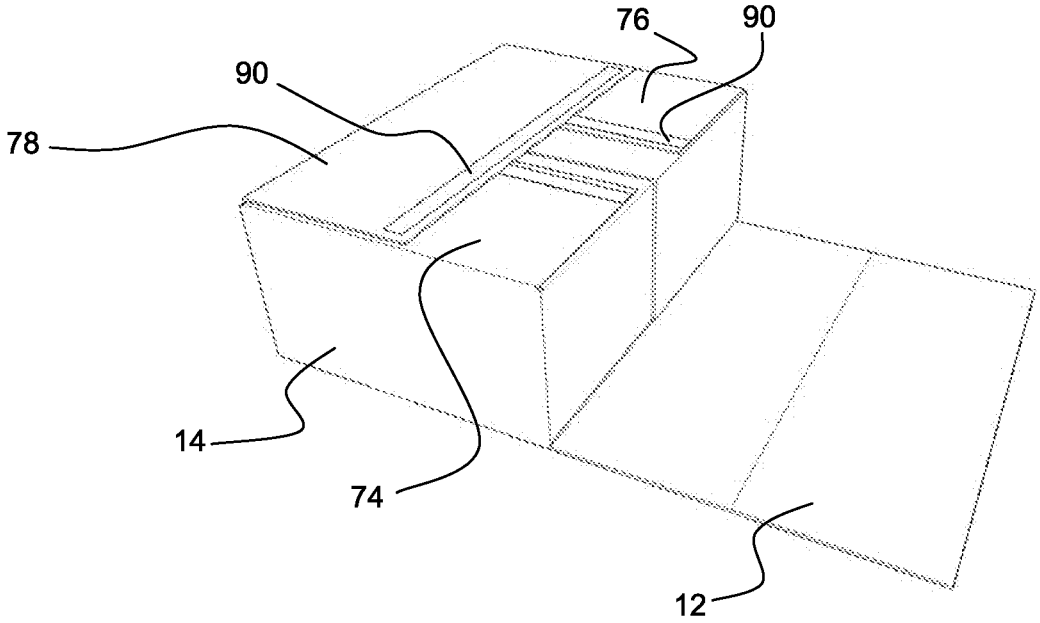
FIG. 17 shows a blank according to FIG. 16 in a state, in which the side panels and the first end panel have been folded such that the respective box formed from the blank is almost closed.

FIGS. 16 and 17 show an embodiment of a prefolded cardboard blank, in which the first end panel 18 and the side panels 14 and 16 at locations, that after folding will form the first, the second and the third top panels (74, 76, 78, 82) have been provided with strips 90 of double-sided adhesive tape, which allows closing the box to be formed from a respective blank without any additional taping or gluing acts.

Figure 18:
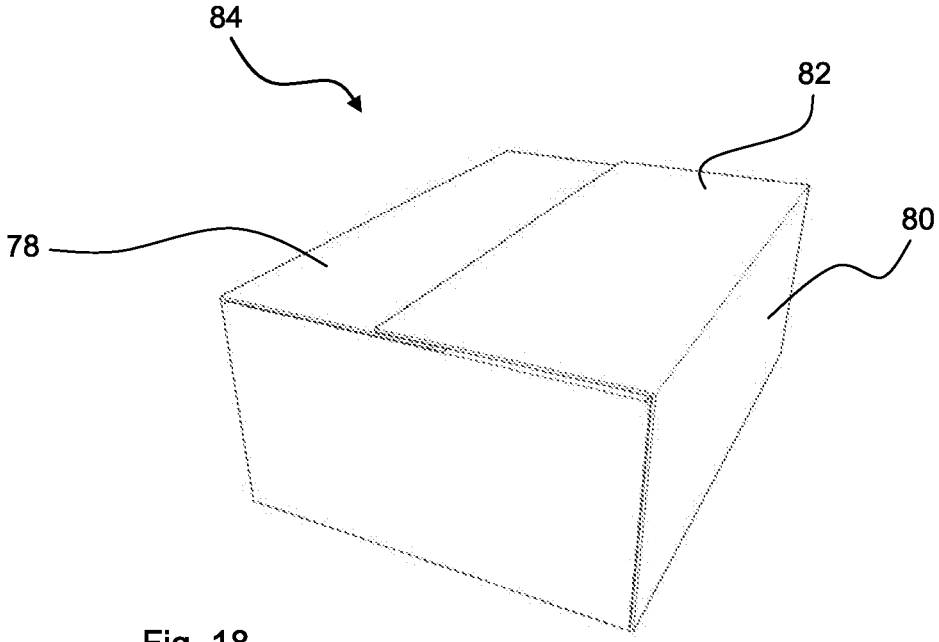
FIG. 18 shows a blank in a state, in which the bottom panel has been folded upwards and then downwards to form a closed box, wherein the folded bottom panel only partially overlaps the top panel created from the first end panel.

FIG. 18 shows a box 84 folded from a prefolded blank, in which the bottom panel has been shortened such that, after folding it to form a second end panel 80 and a further top panel 82, its free end terminates on the top of the box 84 with an overlap with the top panel 78 created from the first end panel. The box may be closed e.g. like the box shown in FIG. 17 with a doubled-sided adhesive tape between the panels 78 and 82, or by placing a strip of adhesive tape along the end of the top panel 82 such that the tape is partially on both top panels 78 and 82.

Figure 19:
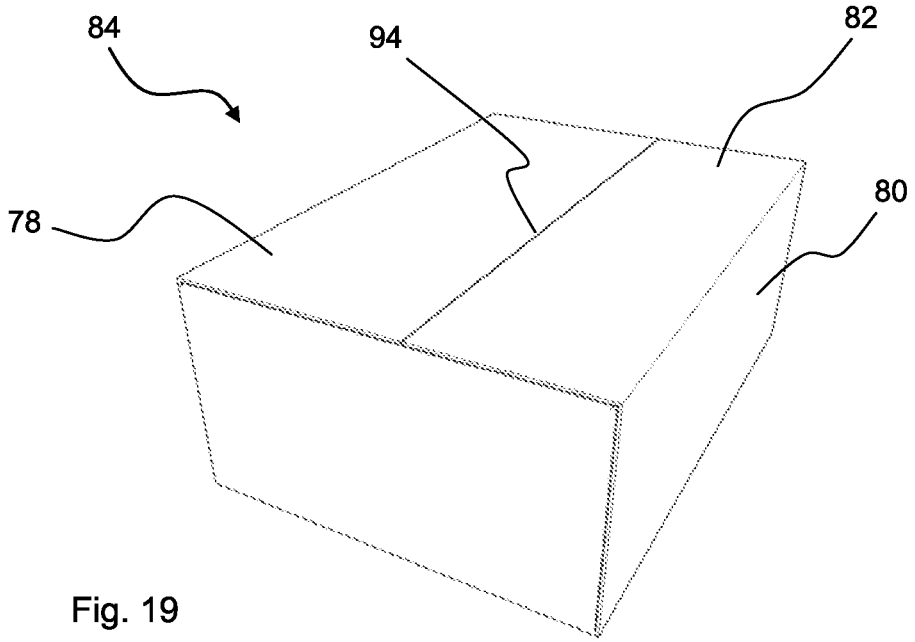
FIG. 19 shows a blank in a state, in which the bottom panel has been folded upwards and then downwards to form a closed box such that the folded bottom panel abuts with the top panel created from the first end panel.
Figure 20:
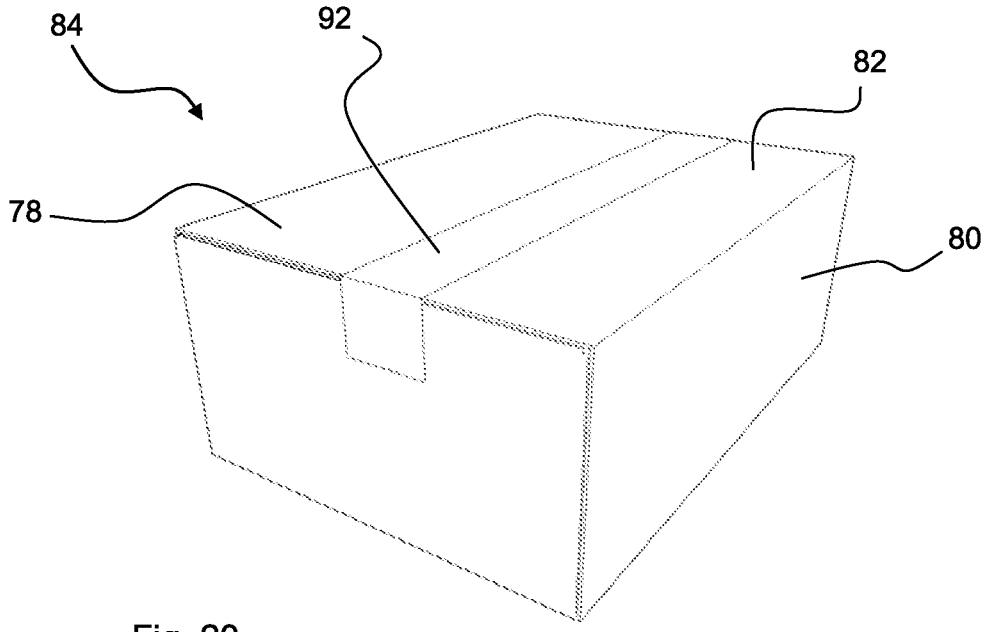
FIG. 20 shows a blank according to FIG. 19 in a state, in which the seam formed from the abutting panels is sealed with a tape.

FIG. 19 shows a box 84 folded from a prefolded blank, in which the bottom panel has been shortened such that, after folding it to form a second end panel 80 and a further top panel 82, its free end terminates shortly before the free end of the top panel 78 created from the first end panel on top of the box 84. Hence, there is no overlap between the top end panels 78 and 82, which now lie in the same plane, which further reduces the height of the box and gives the box a symmetrical appearance, which appeals to most customers. As depicted in FIG. 20, this box too can easily be closed by placing a strip of adhesive tape 92 over the ends of both top panels 78 and 82.

While in the embodiment shown in FIGS. 19 and 20, both top panels 78 and 82 have approximately the same length, such that the seam 94 (FIG. 19) formed between them, runs along a centre line of the box 84, the top panels 78 and 82 may have different length while still approximately abutting against each other, and hence the seam 94 might be offset to one side of the box.

Within the scope of protection of the invention, which is only defined by the appended claims, numerous variations and embodiments are possible. For example, while in the shown embodiments the length of the first end panel corresponds to the width of the side panels, the first end panel may be longer and in turn the bottom panel may be shorter, such that in the folded state the top end panels formed by the free ends of the first end panel and the bottom panel overlap somewhere in the middle of the top of the box or do not overlap at all but abut against each other. It is also apparent from the teaching herein that any crease lines, that may be indented for facilitating the different folding acts, should be arranged such that the thickness of the cardboard, in particular corrugated cardboard which is used for the blank, is taking into account, so that for example the crease line defining the corner panels are in a slightly different plane than the crease line defining the second end panel, in order to allow that all three panels may form a right angle with the respective panel, from which they are folded.

The invention has the great advantage that boxes can easily be adjusted in two dimensions herein called length and height, in order to fit optimal to the arrangement of items to be packaged in the box, and that no separate custom sized closing lid has to be made. The items may be arranged manually or automatically in the box. In order to automate the packaging process at least partially or fully, the dimensions of the arrangement may be measured e.g. by a laser measuring unit or may be calculated from data known about the arrangement and/or the single items in the arrangement. It may be foreseen that a central control unit calculates an optimal arrangement of the items to be packaged and either controls a placing unit for automatically arranging the items or displays the optimal arrangement via a screen to a person manually arranging the items in the box. Further, a control unit and a sensor may be provided, wherein the control unit may be configured to move a cutting and/or creasing device for forming respective slits and/or crease lines into the box until the sensor detects the presence of items arranged in the box.

The invention claimed is:

1. A prefolded cardboard blank for folding closed packaging boxes of varying height and length, said blank comprising:

a bottom panel;

two side panels, each of the side panels joined to opposite edges of said bottom panel;

a first end panel joined with a first edge to said bottom panel, with a second edge to one of said side panels and with a third edge to the other one of said side panels such that the first end panel and the side panels when erected from the bottom panel form together with the bottom panel a box having an open top and an open side;

the first end panel having an end portion intended to form a first top panel, each side panel having an end portion intended to form at least one second top panel and a corner panel the bottom panel having an end portion intended to form a second end panel and a third top panel, and each side panel having a crease line running upwards at an angle of 45° from the bottom panel, from a corner; where the edges of the respective side panel, the first end panel and the bottom panel meet.

2. The prefolded cardboard blank according to claim 1, wherein the prefolded cardboard blank is formed of a single piece of cardboard.

3. The prefolded cardboard blank according to claim 1, wherein the bottom panel is formed from a first piece of cardboard and the first end panel and the side panels are formed from a second piece of cardboard.

4. The prefolded cardboard blank according to claim 1, wherein the dimensions of the panels fulfil the following relations within material-caused tolerances: total length $L_B$ of bottom panel: $L_B = 2\,L + H$, width of bottom panel: W, total length $L_E$ of first end panel $L_E = H + M_2$, width of first end panel: W, total lengths of side panels: $L_s = L + M_1$, width $W_s$ of side panels: $W_s = H + M_2$, wherein L denotes the maximum length of a desired box to be folded from the prefolded cardboard blank, H denotes the maximum height of such box, W denotes the width of such box and $M_1$ and $M_2$ denote a minimum overlap of the end portions of the panels chosen depending on the cardboard used for making the blank and the desired stability of the box to be folded.

5. The prefolded cardboard blank according to claim 4, wherein slits of length $M_2$ are provided in a number of top end corners between the first end panel and the side panels and slits of length $M_1$ are provided between the free ends of the side panels and the bottom panel.

6. The prefolded cardboard blank according to claim 1, further comprising strips of double-sided adhesive tape provided on at least some of the panels forming the first, the second and the third top panels.

7. The prefolded cardboard blank according to claim 1, wherein the first end panel and the side panels each are provided with a number of parallel crease lines at predetermined height from the bottom panel.

8. A method for folding a closed packaging box of varying height and length using a prefolded blank, the prefolded blank including a bottom panel, two side panels, each joined to opposite edges of said bottom panel and a first end panel joined with a first edge to said bottom panel, with a second edge to one of said side panels and with a third edge to the other one of said side panels such that the first end panel and the side panels when erected from the bottom panel form together with the bottom panel a box having an open top and an open side, the first end panel having an end portion intended to form a first top panel, each side panel having an end portion intended to form at least one second top panel and a corner panel, the bottom panel having an end portion intended to form a second end panel and a third top panel, and each side panel having a crease line running upwards at an angle of 45° from the bottom panel, from a corner, where the edges of the respective side panel, the first end panel and the bottom panel meet, the method comprising:

incising the corners between the first end panel and the side panels from the open top down to a desired height of the box to be folded;

incising the side panels down from the open top to said desired height of said box to be folded at a desired length of said box;

incising the junctions between each side panel and the bottom panel from the free end of each side panel to said desired length of said box;

folding the side panels inwards at said desired length to form corner panels;

folding the free ends of said corner panels downwards at said desired height to form top panels;

folding the side panels down at said desired height to form top panels;

folding the first end panel downwards at said desired height to form a top panel and folding the free end of the bottom panel upwards at said desired length to form a second end panel and then downwards at said desired height to form a top panel.

9. The method according to claim 8, further comprising:

creasing the first end panel and the side panels at the desired height of the box;

creasing said side panels at the desired length of the box; and creasing said bottom panel at the desired length and at the desired height of the box.

10. The method according to claim 8, further comprising: shortening the bottom panel such that the length of the top panel formed from the bottom panel does not exceed the length of the desired box.

11. The method of claim 8, further comprising:

cutting away the corner of each side panel above said desired height and beyond said desired length before folding the side panels inwards at said desired length to form corner panels.

12. The method according to claim 11, further comprising:

creasing the first end panel and the side panels at the desired height of the box;

creasing said side panels at the desired length of the box; and creasing said bottom panel at the desired length and at the desired height of the box.

13. The method according to claim 11, further comprising: shortening the bottom panel such that the length of the top panel formed from the bottom panel does not exceed the length of the desired box.

14. A system to fold a closed packaging box of varying height and length using a prefolded blank, the prefolded blank including a bottom panel, two side panels, each joined to opposite edges of said bottom panel and a first end panel joined with a first edge to said bottom panel, with a second edge to one of said side panels and with a third edge to the other one of said side panels such that the first end panel and the side panels when erected from the bottom panel form together with the bottom panel a box having an open top and an open side, the first end panel having an end portion intended to form a first top panel, each side panel having an end portion intended to form at least one second top panel and a corner panel, the bottom panel having an end portion intended to form a second end panel and a third top panel, and each side panel having a crease line running upwards at an angle of 45° from the bottom panel, from a corner, where the edges of the respective side panel, the first end panel and the bottom panel meet, the system comprising:

at least one cutting station including one or more cutters that are selectively operable to:

incise the corners between the first end panel and the side panels from the open top down to a desired height of the box to be folded, incise the side panels down from the open top to said desired height of said box to be folded at a desired length of said box, incise the junctions between each side panel and the bottom panel from the free end of each side panel to said desired length of said box, at least one folding station including one or more structure to:

fold the side panels inwards at said desired length to form corner panels, fold the free ends of said corner panels downwards at said desired height to form top panels, fold the side panels down at said desired height to form top panels, fold the first end panel downwards at said desired height to form a top panel and fold the free end of the bottom panel upwards at said desired length to form a second end panel and then downwards at said desired height to form a top panel.

15. The system according to claim 14, further comprising: a sealing station to fix the top end panel formed by the end portion of the bottom panel to the top panel formed by the end portion of the first end panel.

16. The system according to claim 14 wherein the one or more cutters of the at least one cutting station is further selectively operable to:

cut away the corner of each side panel above said desired height and beyond said desired length.

17. The system according to claim 16, further comprising: a sealing station for fixing the top end panel formed by the end portion of the bottom panel to the top panel formed by the end portion of the first end panel.

* * * * *